US012173574B2

(12) United States Patent
Stephenson et al.

(10) Patent No.: US 12,173,574 B2
(45) Date of Patent: Dec. 24, 2024

(54) METHOD AND APPARATUS FOR WELL TUBULAR FLOTATION

(71) Applicant: Deep Casing Tools, Ltd., Aberdeenshire (GB)

(72) Inventors: David John Stephenson, Aberdeen (GB); Tomasz Jozef Walerianczyk, Tarnowiec (PL)

(73) Assignee: Deep Casing Tools, Ltd., Aberdeenshire (GB)

( * ) Notice: Subject to any disclaimer, the term of this patent is extended or adjusted under 35 U.S.C. 154(b) by 0 days.

(21) Appl. No.: 18/503,483

(22) Filed: Nov. 7, 2023

(65) Prior Publication Data

US 2024/0068311 A1 Feb. 29, 2024

Related U.S. Application Data

(60) Division of application No. 17/398,194, filed on Aug. 10, 2021, now Pat. No. 11,828,119, which is a continuation of application No. PCT/IB2020/051311, filed on Feb. 17, 2020.

(60) Provisional application No. 62/806,119, filed on Feb. 15, 2019.

(51) Int. Cl.

| | |
|---|---|
| ***E21B 23/04*** | (2006.01) |
| ***E21B 33/12*** | (2006.01) |
| ***E21B 34/06*** | (2006.01) |

(52) U.S. Cl.

CPC ..... *E21B 23/0413* (2020.05); *E21B 33/12* (2013.01); *E21B 34/063* (2013.01)

(58) Field of Classification Search

CPC .... E21B 23/0413; E21B 33/12; E21B 34/063; E21B 43/10; E21B 33/14

See application file for complete search history.

(56) References Cited

U.S. PATENT DOCUMENTS

| | | | | |
|---|---|---|---|---|
| 3,980,134 | A * | 9/1976 | Amancharla | E21B 33/1294 166/317 |
| 4,986,361 | A | 1/1991 | Mueller et al. | |
| 9,593,542 | B2 | 3/2017 | Getzlaf et al. | |
| 10,316,626 | B2 * | 6/2019 | Keshishian | E21B 43/10 |
| 11,199,071 | B2 * | 12/2021 | Helms | E21B 33/12 |

(Continued)

FOREIGN PATENT DOCUMENTS

WO 2018/237203 A1 12/2018

OTHER PUBLICATIONS

International Search Report, International Application No. PCT/IB2020/051311 dated Jun. 3, 2020.

(Continued)

*Primary Examiner* — Steven A MacDonald

(74) *Attorney, Agent, or Firm* — Richard A. Fagin

(57) ABSTRACT

A wellbore tubular flotation device comprises a housing having a locking element disposed thereon. The housing is shaped to move through an interior of a wellbore tubular segment. The locking element is shaped to engage the interior of the wellbore tubular segment. The locking element comprises a locking mechanism configured to urge the locking element into contact with the interior of the wellbore tubular. A burst disk is engaged with the housing and is shaped to close the tubular segment to fluid flow. A release mechanism is configured to reverse the urging of the locking mechanism when a release tool is moved through the housing.

10 Claims, 2 Drawing Sheets

(56) References Cited

U.S. PATENT DOCUMENTS

| | | | | |
|---|---|---|---|---|
| 11,230,905 | B2 * | 1/2022 | Helms | E21B 34/063 |
| 11,639,641 | B2 * | 5/2023 | Stratton | E21B 29/00 166/376 |
| 2010/0147517 | A1 * | 6/2010 | D'Arcy | E21B 33/16 166/291 |
| 2010/0243277 | A1 * | 9/2010 | Ring | E21B 43/105 166/387 |
| 2013/0240207 | A1 * | 9/2013 | Frazier | E21B 33/13 166/135 |
| 2014/0190685 | A1 * | 7/2014 | Frazier | E21B 33/1208 166/135 |
| 2014/0224505 | A1 * | 8/2014 | Ramon | E21B 23/01 166/376 |
| 2016/0333658 | A1 * | 11/2016 | Keshishian | E21B 37/10 |
| 2018/0073321 | A1 * | 3/2018 | Watson | E21B 33/124 |

OTHER PUBLICATIONS

Written Opinion of the International Search Authority, International Application No. PCT/IB2020/051311 dated Jun. 3, 2020.

Office Action dated Nov. 25, 2022, for Canadian Application No. 3,134,409.

Office Action dated Aug. 24, 2023, for Canadian Application No. 3,134,409.

1st Substantive Examination and translation, dated Jun. 1, 2023, Saudi Arabia Application No. Application No. 521430070.

* cited by examiner

METHOD AND APPARATUS FOR WELL TUBULAR FLOTATION

CROSS REFERENCE TO RELATED APPLICATIONS

Divisional of U.S. application Ser. No. 17/398,194 filed on Aug. 10, 2021, which application is a continuation of International Application No. PCT/IB2020/051311 filed on Feb. 17, 2020. Priority is claimed from U.S. Provisional Application No. 62/806,119 filed on Feb. 15, 2019. All the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of installing ("running") conduit (tubulars) into subsurface wells. More specifically, the disclosure relates to devices and methods for running tubulars assisted by buoyancy.

U.S. Pat. No. 9,593,542 issued to Getzlaf et al. discloses an apparatus used to seal the interior of a tubular string such as casing or liner for the purpose of using buoyancy to assist running such tubular string in a wellbore having a substantial lateral extent. As is known in the art, substantial lateral extent impedes running tubular strings in a well as a result of friction between the tubular string and the wellbore wall. Buoyancy devices have as a purpose lifting the tubular string in a lateral wellbore section from the bottom of the wellbore to reduce such friction.

The apparatus disclosed in the '542 patent is a burst disk assembly comprising a burst disk, an upper tubular portion and a lower tubular portion, and a securing mechanism for holding the rupture disc between the upper and lower tubular portions. A float tool for creating a buoyant chamber in a casing string may include the burst disk assembly and a sealing device for sealing the lower end of the casing string. The buoyant, sealed chamber may be created therebetween. In operation, applied fluid pressure causes the burst disk assembly to move downward in the tubular. The burst disk may be shattered by contact with a device or surface on a lower portion of the tubular. Full casing internal diameter may be restored in the region where the burst disk formerly sealed the casing.

The rupture disc is described in the '542 patent as being, "made of frangible material. For example, the disc may be made of materials such as carbides, ceramic, metals, plastics, glass, porcelain, alloys, composite materials, etc. Such materials may leave debris in the well, and such debris may interfere with subsequent operations in the well. In many long lateral wellbore completions it is desirable to avoid, to the extent possible, leaving debris in the wellbore tubular generated by using wellbore tools, such as the flotation device disclosed in the '542 patent.

SUMMARY

A wellbore tubular flotation device according to a first aspect of the present disclosure includes a housing having a locking element disposed thereon. The housing is shaped to move through an interior of a wellbore tubular segment. The locking element is shaped to engage the interior of the wellbore tubular segment. The locking element comprises a locking mechanism configured to urge the locking element into contact with the interior of the wellbore tubular. A burst disk is engaged with the housing and shaped to close the tubular segment to fluid flow. A release mechanism is configured to reverse the urging of the locking mechanism when a release tool is moved through the housing.

In some embodiments, the locking mechanism comprises at least one piston, the release mechanism comprising a sleeve slidably engaged with an interior of the housing, the housing having hydraulic pressure passages therein connected to the piston, a bore of the sleeve defining a volume exposed to the hydraulic pressure passages when the sleeve is moved by the release tool.

In some embodiments, the release tool comprises a pumpable plug having a smaller diameter nose than a body of the plug, and the sleeve comprises an internal ring having a diameter larger than a diameter of the nose. The diameter of the internal ring is smaller than a diameter of the pumpable plug body.

In some embodiments, the plug comprises a cement wiper plug.

In some embodiments, the housing comprises wiper seals engageable with the interior of the tubular element.

In some embodiments, the locking mechanism comprises at least one cam pivotally coupled to the housing so as to urge the locking element into contact with the interior of the wellbore tubular segment when the at least one cam is rotated in a first direction and to reverse movement of the locking element from the interior of the wellbore tubular segment when rotated opposite to the first direction.

In some embodiments, the plug comprises a cement wiper plug.

A method for moving a tubular string into a wellbore includes locking a flotation device comprising a housing and a burst disk in the tubular string. The tubular string is moved to a selected depth in the wellbore. Pumping on the tubular string is performed to rupture the burst disk. The flotation device is released from the tubular string by pumping a release tool into the flotation device.

In some embodiments, the locking the flotation device comprises applying hydraulic pressure to a piston engaged with a locking element.

In some embodiments, the releasing comprises moving a release sleeve in the flotation device to expose the hydraulic pressure to a volume to relieve the hydraulic pressure.

In some embodiments, the pumping the release tool comprises pumping a plug into a ring in the flotation device, the ring having a diameter larger than a nose of the plug and smaller than a body of the plug, whereby pumping the plug moves the ring and consequently the release sleeve.

In some embodiments, the locking comprises moving at least one cam in a first direction to urge a locking element into contact with the tubular string.

In some embodiments, the releasing comprises the release tool moving the at least one cam in a direction opposed to the first direction.

In some embodiments, the moving the at least one cam in the opposed direction comprises pumping a plug into a ring in the flotation device, the ring having a diameter larger than a nose of the plug and smaller than a body of the plug, whereby pumping the plug moves the ring and consequently the at least one cam.

Other aspects and possible advantages will be apparent from the description and claims that follow.

DETAILED DESCRIPTION

Figure 1:
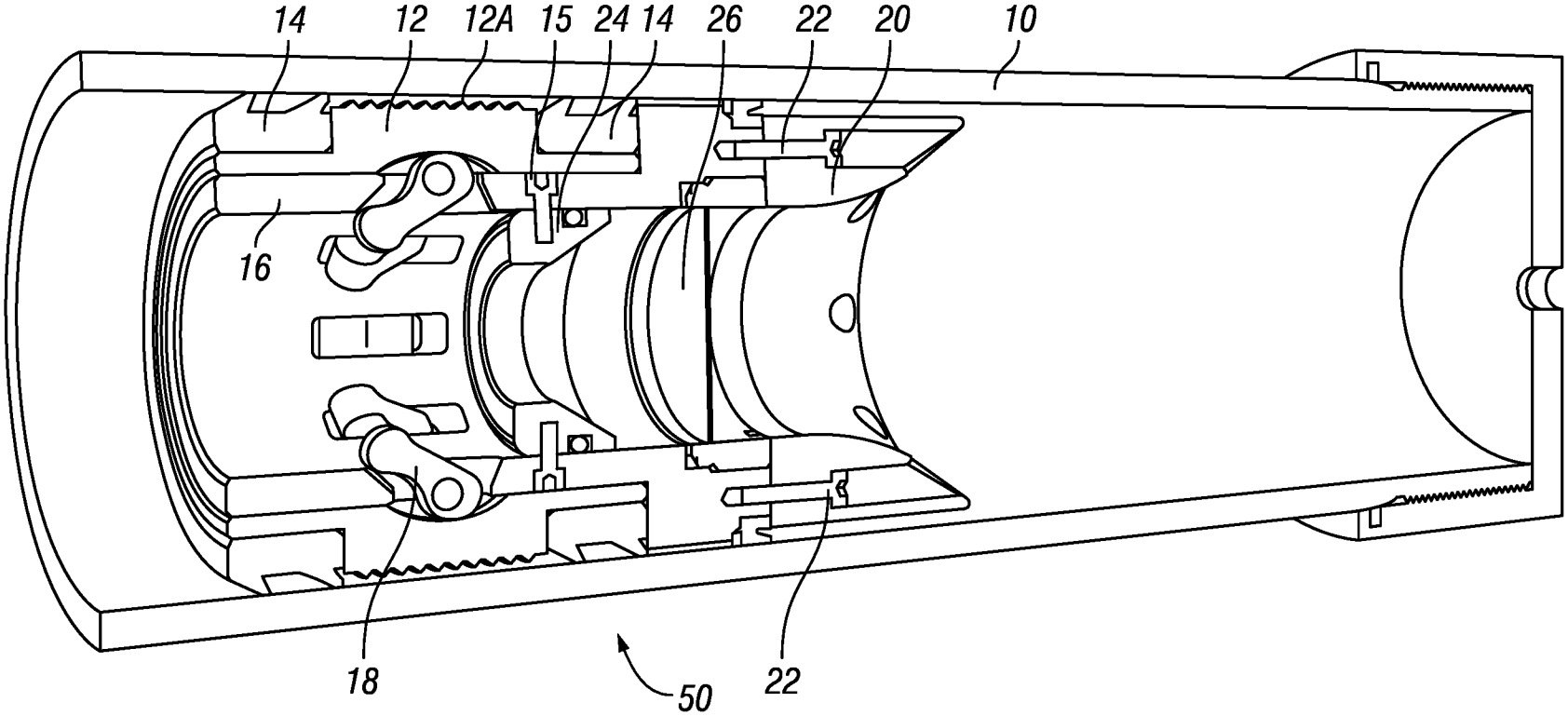
FIG. 1 shows an example embodiment of a wellbore tubular flotation device.

FIG. 1 shows an example embodiment of a wellbore tubular flotation device 50 according to the present disclosure. A wellbore tubular segment 10 such as a segment of a casing or liner may be fitted with the wellbore tubular flotation device 50 while such tubular segment 10 is at the surface, for example, prior to inserting the tubular segment 10 into a wellbore. The wellbore tubular flotation device 50 may comprise a housing 16 able to be moved along the interior of the tubular segment 10. The housing 16 may comprise therein a locking mechanism, which in this embodiment may comprise one or more cams 18 pivotally coupled to the housing 16. In FIG. 1, the one or more cams 18 are shown in the released position such that the wellbore tubular flotation device 50 including the housing 16 may move freely along the interior of the wellbore tubular segment 10. A release mechanism may comprise a receiving shoe 24 for a pumpable device such as a "dart." The receiving shoe 24 may be sealingly coupled to the interior of the housing 16 and held in longitudinal position by one or more shear pins 15, shear bolts or similar devices. The exterior of the housing 16 may comprise one or more wiper seals 14 arranged to enable the housing 16 to be moved (e.g., downwardly, which in FIG. 1 is to the left of the drawing) within the tubular segment 10 on application of fluid pressure to one end the tubular segment 10.

To longitudinally fix the wellbore tubular flotation device 50 within the wellbore tubular segment, the one or more cams 18 may be rotated, in FIG. 1 toward the right hand side of the figure, to urge one or more corresponding locking elements 12 radially outwardly from the housing 16 and into engagement with the interior wall of the tubular segment 10. A burst disk 26 may be inserted into the housing 12 and retained therein by a retainer sleeve 20. The burst disk 26 may be any known type to rupture at a predetermined differential pressure, and may be made from a material that minimizes the amount of free debris after rupture. The retainer sleeve 20 may be held in place in the housing 16 by one or more cap screws 22. The use of cap screws to hold the retainer sleeve 20 in place in the housing 16 is not a limitation on the scope of this disclosure. The retainer sleeve may also serve as a guide bushing for a release plug, to be explained further below.

To assemble the flotation device 50 of FIG. 1 to a wellbore tubular segment, the housing 16 having the components described above, less the burst disk 26 and retainer sleeve 20, may be moved to a selected longitudinal position within the tubular segment 10. The one or more cams 18 may then be rotated so as to urge the corresponding one or more locking elements 12 radially outwardly and into contact with the interior wall or surface of the tubular segment 10. The one or more locking elements 12 may comprise, for example, gripping elements 12A such as teeth or dogs to engage the interior surface of the tubular segment 10 so as to retain the housing 16 in its longitudinal position within the tubular segment 10. The burst disk 26 may be inserted into the housing 16 and the retainer sleeve 20 then assembled to the housing 16.

The foregoing assembly of the flotation device 50 into the wellbore tubular segment 10 may then be assembled to a wellbore tubular string, e.g., a casing or liner, as such tubular string is inserted ("run") into a wellbore. Because the tubular flotation device 50 seals the interior of the tubular segment 10, as the assembled tubular string is run into the wellbore, it may remain free of wellbore fluid, that is, wellbore fluid may be excluded from the interior of the wellbore tubular string and thereby defines a fluid excluded volume. Such fluid excluded volume may provide buoyancy to the tubular string when the wellbore is filled with liquid. Once the tubular string is run to its desired depth in the wellbore, fluid pressure may be applied to the tubular string at a pressure above the rupture pressure of the burst disk 26. Once the burst disk 26 is ruptured, fluid flow through the flotation device may be established. For example, cement may be pumped into the tubular string. Such pumped cement may be followed by a wiper plug to displace the cement from the interior of the tubular string in a conventional cementing operation. In the present example embodiment, the wiper plug may comprise a nose having a profile diameter smaller at the nose end than a remainder of the wiper plug, thereby enabling movement of the nose through the interior of the receiving shoe 24 (the nose being called a "dart" for convenience). Further movement of the dart through the receiving shoe 24, however, may be prevented by the larger diameter of the wiper plug past the nose, thus sealing the interior of the floatation device 50 from further fluid flow along the interior of the tubular string. Thus, further pumping on the wiper plug (dart) will result in pressure increase and consequent longitudinal force on the floatation device 50, eventually causing rupture of the shear pins 15 and subsequent movement of the receiving shoe 24 to urge the one or more cams 18 to rotate. Such rotation of the one or more cams 18 releases the corresponding locking element(s) 12, freeing the tubular floatation device 50 to move within the tubular string. The entire tubular flotation device 50 may then be moved to the lower (bottom) longitudinal end of the tubular string by continued pumping. Conventional wellbore completion operations after cement pumping may then be undertaken.

Figure 2:
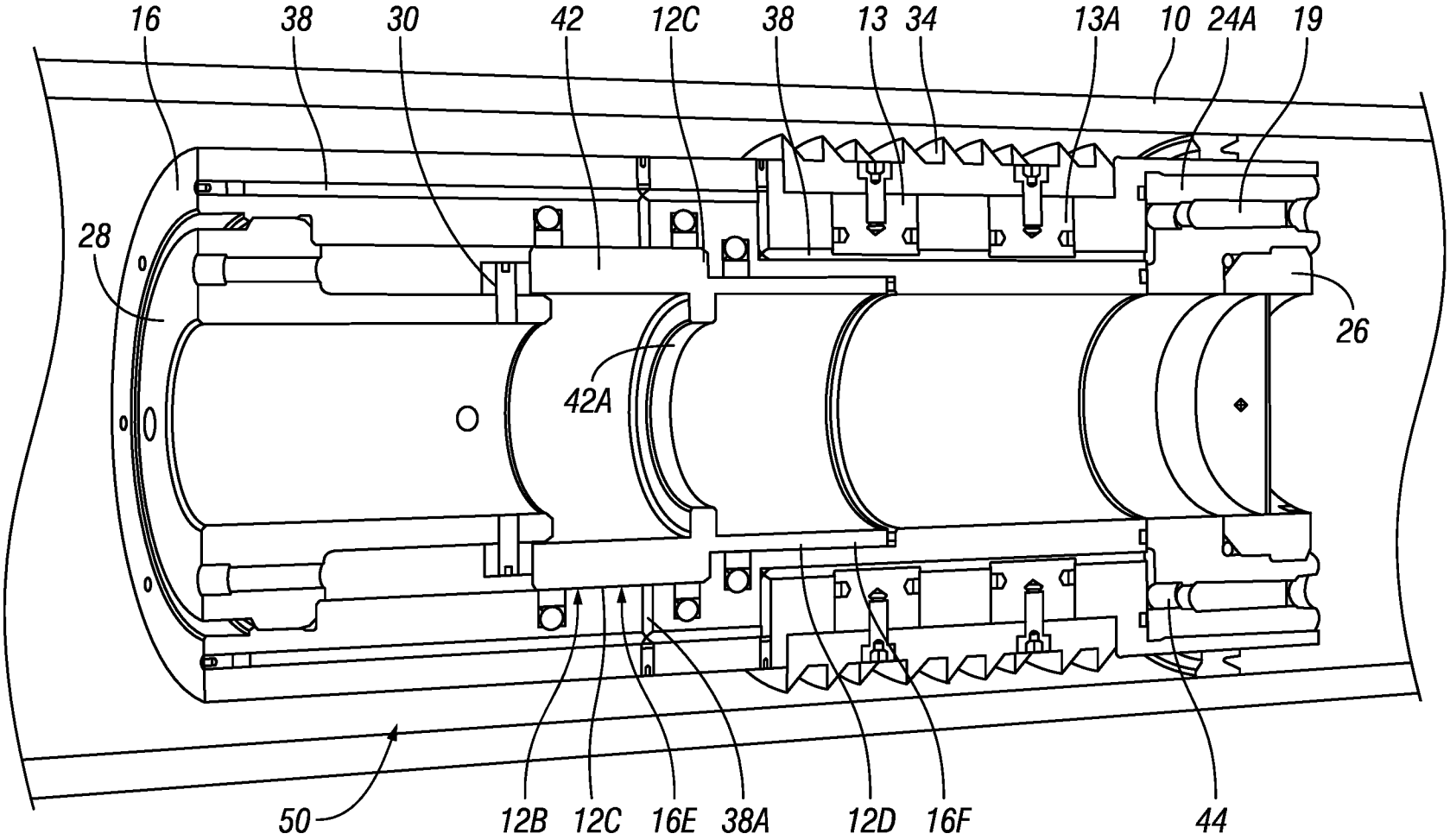
FIG. 2 shows an example of another embodiment of a wellbore tubular flotation device.

FIG. 2 shows another example embodiment of a tubular flotation device 50 according to the present disclosure. The present example embodiment of the flotation device 50 may be assembled to a tubular segment 10 prior to assembly or during assembly of the tubular segment 10 to tubular string, just as for the previous embodiment explained with reference to FIG. 1. A housing 16 may comprise hydraulic fluid passages 38 drilled therein, which may comprise bores for receiving locking pistons 13 disposed in corresponding cylinders 13A. The hydraulic fluid passages 38 may terminate onto a burst disk receiver 24A disposed into one end of the housing 16. The burst disk receiver 24A may comprise one or more fluid inlet ports 44 in fluid communication with the hydraulic passages 38, wherein the fluid inlet ports 44 are terminated by a check valve 19. During assembly, the housing 16 is moved to a desired longitudinal position within the tubular segment 10. Hydraulic pressure may then be applied to the one or more fluid inlet ports 44. The hydraulic fluid pressure will urge the locking piston(s) 13 outwardly from the respective cylinder 13A so that locking element(s) 34 are urged into contact with the interior wall of the tubular segment 10. The one or more fluid inlet ports 44 may then be closed by insertion of a corresponding cap screw or similar plug (not shown) into the end of the respective inlet port 44. The housing 16 will thus be locked in place in the tubular segment 10. A burst disk 26 may then be inserted into the burst disk receiver 24A. The assembled flotation device 50 and tubular segment 10 may then be assembled to a tubular string as explained with reference to FIG. 1.

When the tubular string is inserted to its desired depth in the wellbore, the flotation device 50 may be operated to open the interior of the tubular string to fluid flow. Such opening may be performed by applying fluid pressure in excess of the burst disk 26 rupture pressure. Upon rupture of the burst disk 26, fluid circulation through the tubular string may be established. The flotation device 50 may be released from the interior of the tubular string and moved to the end of the tubular string by pumping a wiper plug (e.g., after pumping cement) as explained with reference to FIG. 1. In the present example embodiment, the wiper plug may comprise a nose having a diameter selected to engage a seating ring 42A on a release sleeve 42 slidably disposed in the interior of the housing 16. The release sleeve 42 may be held in place initially by one or more shear pins 30 or the like disposed both on and engaged with a mandrel 28 inserted into the housing 16. When the wiper plug is pumped against the release sleeve 42, the force eventually breaks the shear pins 30 enabling the release sleeve 42 to move toward and along the mandrel 28. As the release sleeve 42 moves in such direction, a shoulder 12C on a larger outer diameter (OD) portion 12B of the release sleeve 42 exposes a smaller bore portion 16F in the housing 16 in which a smaller OD portion 12D of the release sleeve 42 thus enters a larger bore portion 16E of the housing 16. Such movement eventually exposes a bleed port 38A, fluidly connected to the passages 38, to the volume defined between the smaller OD portion 12D and the larger bore portion 16E. Such defined volume provides a place for pressurized hydraulic fluid in the passages 38, and consequently the cylinders 13A, to release. The released pressure enables the pistons 13 to collapse into their respective cylinders 13A, thus releasing the locking elements 34. The flotation device 50 may then be moved to the longitudinal (bottom) end of the tubular string, as explained with reference to FIG. 1. The movement of the release sleeve 42 to the left, in addition to depressurizing the fluid under the release pistons 42 also creates a "negative" (lower than ambient) pressure that assists retracting the release pistons 42. The amount of negative pressure should at least that needed to overcome the friction of piston seals (not shown).

In general, wellbore tubular flotation devices according to the present disclosure may be installed into a segment (joint) of wellbore tubular such as a casing or liner at the surface by setting a locking element to fix the longitudinal position of the flotation device in the tubular segment. The tubular segment may be attached to or assembled within the tubular string as it is run into a wellbore. After the tubular string is run to the desired depth in the wellbore, a fluid seal created by the flotation device may be opened by applying fluid pressure to the tubular segment above a selected opening pressure to rupture the burst disk. In the described embodiments, the opening pressure may be selected by suitable choice of the pressure burst disk. Once the burst disk is opened to fluid flow, the locking element may be released by pumping a suitable release tool into the tubular string. In the described embodiments, the release tool may comprise a wiper plug having a nose profile (smaller diameter nose) shaped to engage the locking element's release feature, thereby releasing the locking element so the flotation device is released from the interior wall of the tubular segment. The flotation device may then be pumped to the bottom of the tubular string and subsequently removed in the manner conventionally used to drill out casing/liner float equipment and casing/liner shoes.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for moving a tubular string into a wellbore comprising:

locking a flotation device comprising a housing and a burst disk in a tubular segment of the tubular string, wherein the tubular segment has a smooth internal bore absent of features over its entirety;

moving the tubular string to a selected depth in the wellbore;

pumping on the tubular string to rupture the burst disk; and releasing the entire flotation device from the tubular string by pumping a release tool into the flotation device, wherein the release tool causes locking elements to disengage from contact with an interior wall of the tubular string.

2. The method of claim 1 wherein the locking the flotation device comprises applying hydraulic pressure to a piston engaged with each of the locking elements.

3. The method of claim 2 wherein the releasing comprises moving a release sleeve in the flotation device to expose the hydraulic pressure to a volume to relieve the hydraulic pressure.

4. The method of claim 1 wherein the pumping the release tool comprises pumping a plug into a ring in the flotation device, the ring having a diameter larger than a nose of the plug and smaller than a body of the plug, whereby pumping the plug moves the ring and consequently the release sleeve.

5. The method of claim 4 wherein the locking comprises moving at least one cam in a first direction to urge the locking elements into contact with the tubular segment.

6. The method of claim 5 wherein the releasing comprises the release tool moving the at least one cam in a direction opposed to the first direction.

7. The method of claim 6 wherein the moving the at least one cam in the opposed direction comprises pumping a plug into a ring in the flotation device, the ring having a diameter larger than a nose of the plug and smaller than a body of the plug, whereby pumping the plug moves the ring and consequently the at least one cam.

8. A method for moving a tubular string into a wellbore comprising:

locking a flotation device comprising a housing and a burst disk in the tubular string, wherein the locking comprises moving at least one cam in a first direction to urge a locking element into contact with the tubular string;

moving the tubular string to a selected depth in the wellbore;

pumping on the tubular string to rupture the burst disk; and releasing the flotation device from the tubular string by pumping a release tool into the flotation device, wherein the pumping the release tool comprises pumping a plug into a ring in the flotation device, the ring having a diameter larger than a nose of the plug and smaller than a body of the plug, whereby pumping the plug moves the ring and consequently a release sleeve.

9. The method of claim 8 wherein the releasing comprises moving the release sleeve in the flotation device to expose the hydraulic pressure to a volume to relieve the hydraulic pressure.

10. The method of claim 8 wherein the releasing comprises the release tool moving the at least one cam in a direction opposed to the first direction.

* * * * *